US009502794B2

(12) United States Patent
Cooney

(10) Patent No.: US 9,502,794 B2
(45) Date of Patent: Nov. 22, 2016

(54) FIELD-REPLACEABLE TERMINAL BLOCK DIVIDER

(71) Applicant: Hamilton Sundstrand Corporation, Charlotte, NC (US)

(72) Inventor: Robert C. Cooney, Janesville, WI (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 21 days.

(21) Appl. No.: 14/568,218

(22) Filed: Dec. 12, 2014

(65) Prior Publication Data

US 2015/0194750 A1 Jul. 9, 2015

Related U.S. Application Data

(60) Provisional application No. 61/924,006, filed on Jan. 6, 2014.

(51) Int. Cl.
*H01R 9/24* (2006.01)

(52) U.S. Cl.
CPC ..... *H01R 9/2408* (2013.01)

(58) Field of Classification Search
USPC ..... 439/715, 884, 709, 717, 712; 310/71; 174/176; 257/690
See application file for complete search history.

(56) References Cited

U.S. PATENT DOCUMENTS

| | | | | |
|---|---|---|---|---|
| 2,892,176 | A | 6/1959 | Gordon | |
| 4,683,695 | A | 8/1987 | Galli | |
| 5,295,870 | A | 3/1994 | Rei et al. | |
| 5,315,068 | A * | 5/1994 | Barron | H01R 9/26 174/138 E |
| 5,407,367 | A * | 4/1995 | Robertson | H01R 12/515 439/715 |
| 7,097,502 | B2 | 8/2006 | Landis et al. | |
| 7,527,523 | B2 | 5/2009 | Yohn et al. | |
| 2008/0274645 | A1 * | 11/2008 | Yohn | H01R 4/30 439/595 |
| 2013/0252479 | A1 | 9/2013 | Ramey et al. | |

FOREIGN PATENT DOCUMENTS

| | | |
|---|---|---|
| EP | 0170455 A2 | 2/1986 |
| FR | 2988526 A1 | 9/2013 |

* cited by examiner

*Primary Examiner* — Marvin Payen
*Assistant Examiner* — Lawrence Tynes, Jr.
(74) *Attorney, Agent, or Firm* — Cantor Colburn LLP

(57) ABSTRACT

A terminal block assembly with one or more removable dividers. The dividers include a tenon that can be inserted into a groove in one or more blocks. The dividers can be retained by a fastening member, such as a clip, placed at an open end of the groove.

12 Claims, 4 Drawing Sheets

FIELD-REPLACEABLE TERMINAL BLOCK DIVIDER

CROSS-REFERENCE TO RELATED APPLICATIONS

The present application claims the benefit of U.S. Provisional Patent Application Ser. No. 61/924,006, entitled "FIELD-REPLACEABLE TERMINAL BLOCK DIVIDER" filed Jan. 6, 2014, the contents of all of which are incorporated by reference herein.

BACKGROUND

The present disclosure relates generally to terminal block dividers and, more particularly, to terminal block dividers for high power electrical systems such as contained, for example, on an aircraft.

A wide variety of power terminal assemblies exist for use today, depending upon the environment and application. In some high power applications, multiple sets of wires are joined within the power terminal assembly for distribution. Examples of this application may be found in various environments, such as in aircraft electrical and power systems or in manufacturing where equipment is utilized having high power demands.

In order to provide separation between conductive members (e.g., wires) that are connected to the terminal block, terminal blocks in high power electrical systems are frequently configured with dividers, which are disposed between the conductive members or groups of conductive members. These dividers provide general safety and reduce the risk of arcing between conductive members. In some cases, large torque forces are required to detach and secure electrical wiring. This can damage dividers, which may otherwise obstruct the access to the terminal blocks.

SUMMARY

Disclosed herein is a terminal block assembly including one or more blocks formed from an electrically insulating material. One or more terminal connectors are disposed on the blocks. Each block includes at least one groove on a surface thereof, the groove at least partially forming a socket of a sliding dovetail joint.

Another aspect of the disclosure provides a terminal block assembly having an electrically insulated base. A plurality of terminal connectors is disposed in the electrically insulated base. One or more grooves are arranged on the electrically insulated base between two or more of the plurality of terminal connectors, each groove having an open end. The grooves are shaped with a profile having a first dimension measuring a width of the groove that is greater than a second dimension measuring a width of the groove. The first dimension is measured at a location nearer to the surface of the base when compared with the second dimension.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures. It is to be understood that other embodiments may be utilized and changes may be made without departing from the scope of the present disclosure. In particular, the disclosure provides various examples related to high-power terminal blocks for vehicles, such as but not limited to aircraft, whereas the advantages of the present disclosure as applied in a related field would be apparent to one having ordinary skill in the art and are considered to be within the scope of the present invention.

Figure 1A:
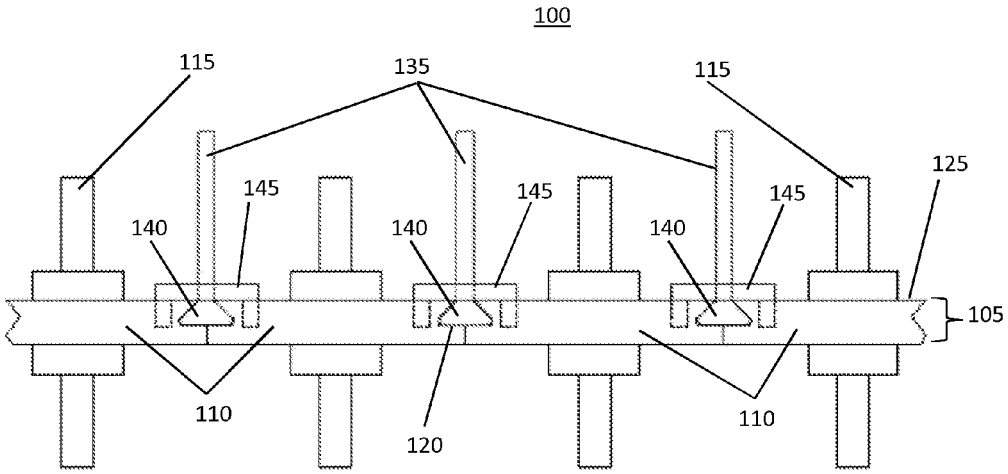
FIGS. 1A and 1B are front and top views, respectively, of a terminal block assembly according to one embodiment.
Figure 1B:
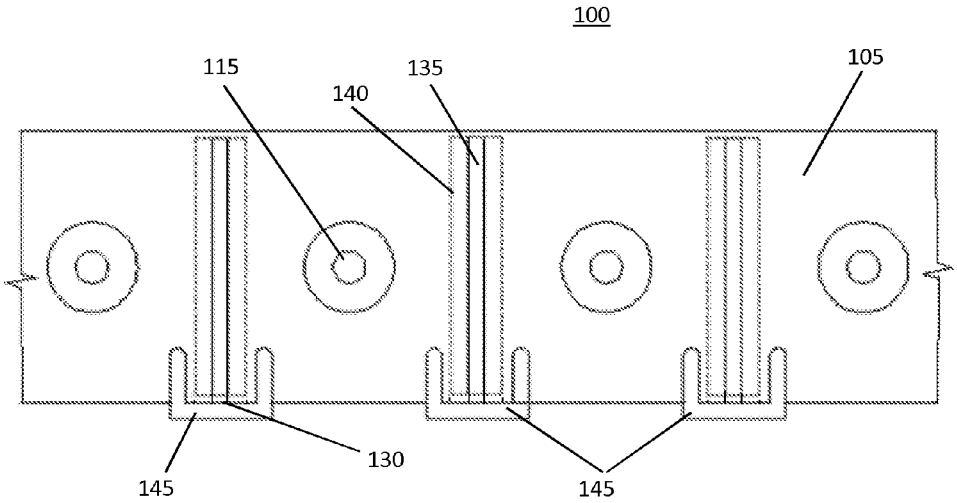

FIGS. 1A and 1B illustrate a terminal block assembly 100 according to one embodiment of the present disclosure. The terminal block assembly 100 includes a base 105 comprised of one or more blocks 110. As illustrated, each block 110 includes one or more terminal connectors 115. One or more grooves 120 are disposed on a surface 125 of the base 105. The grooves 120 are formed, for example, having an open end 130 on a side of the base 105. See FIG. 1B. The terminal block assembly 100 further comprises one or more dividers 135, each divider having a tenon 140 disposed in one of the grooves 120. Also included in the terminal block assembly 100 are one or more fastening members 145.

The terminal block assembly 100 described herein provides the ability to remove and replace the dividers 135 in the field. According to some embodiments, the dividers 135 can be removed and replaced without the use of a tool. This is useful, for example, when performing maintenance or inspection of the terminal block assembly 100. Removal of the dividers 135 in such circumstances can obviate damage to dividers during maintenance. Removal of dividers 135 that have been damaged can prevent further damage to the dividers 135 and to the electrical system.

Figure 2:
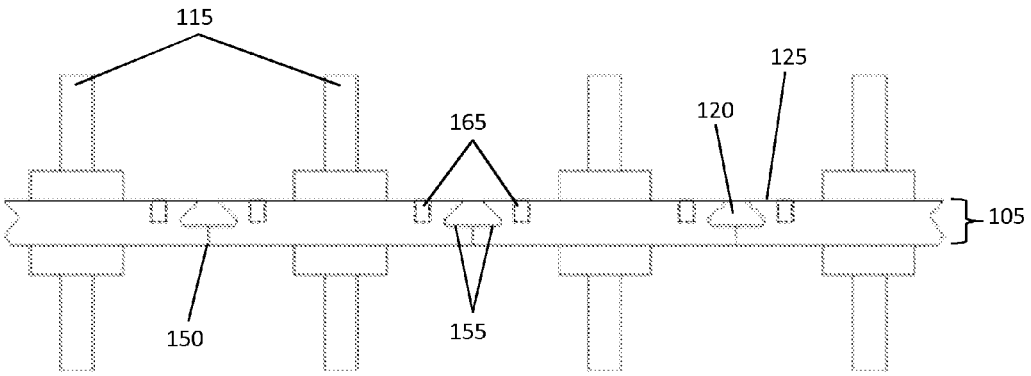
FIG. 2 is an side view of a base of the terminal block assembly according to one embodiment.

FIG. 2 illustrates the base 105 of the terminal block assembly 100 and associated features. As described above, the base 105 of the terminal block assembly 100 is comprised of an electrically insulating material, as is known in the art. As illustrated in FIGS. 1A and 1B, the base 105 may be comprised of one or more blocks 110. The blocks 110 can be arranged in a series, as shown, or any other advantageous arrangement for a particular application. A plurality of terminal connectors 115 are disposed on the base for distributing power and/or signals to associated electrical systems. The base 105 may further comprise an attachment structure (not shown) for arranging the blocks 110 and/or for housing other electrical components, for example, including connections between the various terminal connectors 115.

A number of grooves 120 for receiving the divider 135 are disposed in the base 105. As shown in FIG. 1B, the grooves may be arranged having an open end 130 where the tenon 140 of the divider 135 can be inserted. Alternatively, the base 105 can be constructed with both ends of the grooves 120 being open. For example, the dividers 135 may be retained in the grooves by another structure, such as the attachment structure described herein, by additional fastening members 145, or by some other configuration.

Figure 3:
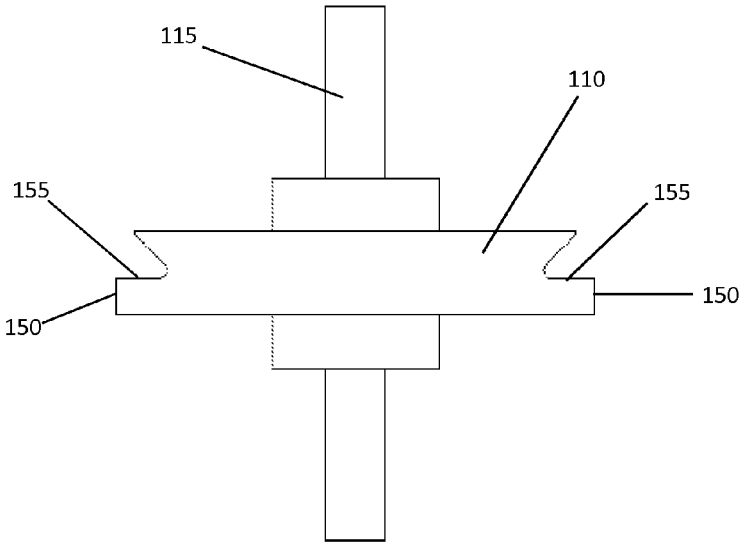
FIG. 3 is a side view of a single block of the terminal block assembly according to one embodiment.

FIG. 3 is an illustration of a block 110 according to one embodiment. A terminal connector 115 is disposed in the block 110. The configuration and arrangement of the terminal connector 115 in the block 110 may vary according to a particular application, as known in the art. In the illustrated embodiment, the block 110 is configured with two adjoining edges 150, each with partial grooves 155 formed therein. When assembled with other blocks, the partial grooves 155 form the groove 120 discussed above. The depicted partial grooves 155 are mirrored on either adjoining edge 150. Alternatively, the partial groove 155 may be formed asymmetrically, which includes configurations where the partial groove 155 is formed by an indentation on one adjoining edge 150 and forms the groove 120 by arranging the partial groove 155 opposite an adjoining edge 150 without a partial groove 155.

Figure 4A:
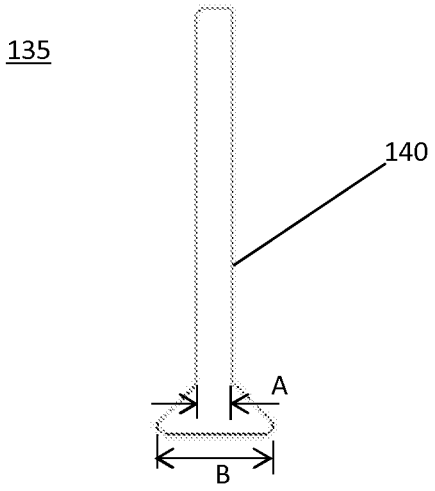
FIGS. 4A and 4B are front and top views, respectively, of a divider according to one embodiment.
Figure 4B:
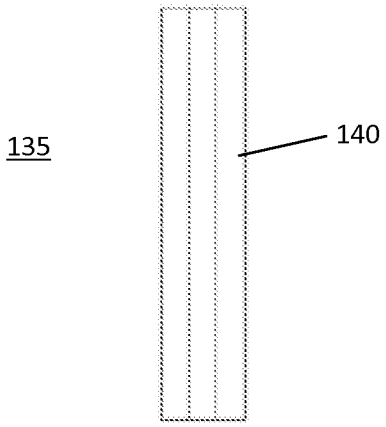
Figure 5A:
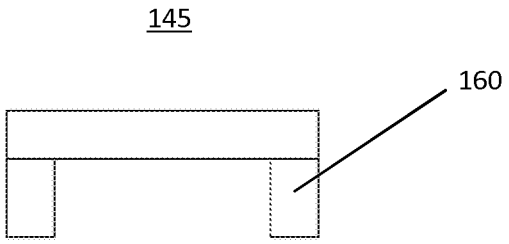
FIGS. 5A and 5B are front and top views, respectively, of a fastening member according to one embodiment.
Figure 5B:
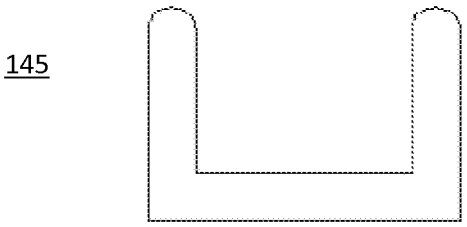

As shown in FIGS. 4A and 4B, the divider 135 largely comprises a flat panel and is formed from an electrically insulating material, as is known in the art. The divider 135 of the present disclosure is formed with a tenon 140, which may be located, for example, at one extent of the divider 135. The tenon 140 is formed having a shape that approximates a profile of the groove 120 when viewed from the open end 130. The tenon 140 and the groove 120 may comprise, for example, a sliding dovetail joint, with the groove 120 forming a socket or mortise. As described herein, the term "dovetail" and "dovetail joint" shall encompass all combinations of shapes that allow the tenon 140 to slide into the groove 120 along a direction of the groove, while restricting movement in another direction, such as a direction orthogonal to the direction of the insertion. Thus, the tenon 140 may be provided having a wedge-like shape, as shown.

Alternatively, the shape of the tenon 140, and of the corresponding groove 120, may be described as having a first dimension A that is less than a second dimension B. As shown in FIG. 4A, the first dimension A with respect to the tenon 140 is measured at a location nearer to the panel of the divider 135 when compared to a location of the second dimension B. Similarly, the first dimension A with respect to the groove 120 is measured at a location nearer to the surface 125 when compared to the second dimension B.

Referring again to FIGS. 1A and 1B, the divider 135 of the present disclosure is retained in the groove 120 by a fastening member 145. The fastening member 145 may comprise any device or fastener that is able to secure the divider 135 within the groove. This includes, for example, threaded fasteners, snaps, clips, clasps, and other devices, as may be apparent to those in the art. Alternatively, the divider 135 may be secured in the groove 120 by an interference fit or other geometric mechanism, without the use of a fastening member 145.

In the embodiment illustrated in FIG. 1B, the fastening member 145 is a clip that can be attached to the base 105 near the open end 130 of the groove 120. As shown in FIGS. 1A, 1B, 5A, and 5B, the fastening member 145 may be formed having one or more projections 160. The projections 160 can be inserted into corresponding indentations 165 (as shown in FIG. 1) in the base 105. The indentations 165 of the embodiment, as illustrated in FIG. 2, are formed on either side of the groove 120 at the open end 130. With the divider 135 inserted into the groove 120, the placement of the fastening member 145 prevents the divider 135 from being removed without first removing the fastening member 145. The geometry of the projections 160 and the indentations 165 may be formed to have an interference fit, as with a snap or similar fastener. Further, the projections 160 may be formed having a serrated geometry to form a fastening member 145 that is secure but can be overcome with a minimal amount of force applied directly to the fastening member 145.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc., do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A terminal block assembly, comprising:

two or more blocks each formed from an electrically insulating material and having one or more terminal connectors disposed thereon and extending from a surface of the respective block, each block having at least one groove formed along an edge of the surface, each groove being configured to form a socket of a sliding dovetail joint when two or more blocks are joined together and when a groove of a first block is aligned with a groove of a second block; and one or more electrically insulating dividers each having a tenon formed thereon, the tenon being configured to be inserted into the socket such that the divider extends from the surface of the blocks.

2. The terminal block assembly of claim 1, each of the two or more blocks includes at least two grooves formed thereon, the grooves being formed on opposite edges of the respective block.

3. The terminal block assembly of claim 1, wherein the two or more blocks are arranged in series, at least one groove of each block being disposed on a side of the blocks at an adjoining edge between the two or more blocks.

4. The terminal block assembly of claim 1, wherein the tenon has a first width and a second width, wherein the first width is less than the second width, the second width being a portion of the tenon configured to fit within the socket.

5. The terminal block assembly of claim 1, wherein the tenon forms a wedge-like shape.

6. The terminal block assembly of claim 1, further comprising one or more fastening members configured to attach to the one or more blocks together when the one or more tenons have been received by the one or more grooves, and configured to prevent the removal of the one or more tenons from the corresponding one or more grooves while the one or more fastening members are attached to the one or more blocks.

7. The terminal block assembly of claim 6, further comprising one or more indentations formed in the one or more blocks, each of the fastening members having one or more projections for inserting into the one or more indentations.

8. A terminal block assembly, comprising:

an electrically insulated base comprised of two or more blocks;

a plurality of terminal connectors disposed in the electrically insulated base, wherein each of the two or more blocks has at least one terminal connector extending from a surface of the respective block;

one or more grooves arranged on the surface of the electrically insulated base, each groove having an open end and being arranged between two or more of the plurality of terminal connectors and between edges of two adjacent blocks that form the electrically insulated base, each groove having a first width that is less than a second width of the groove, the first width being measured at a location nearer to the surface of the base than the second width; and one or more electrically insulating dividers each having a tenon formed thereon, the tenon being configured to be inserted into the grooves such that the divider extends from the surface of the electrically insulated base.

9. The terminal block assembly of claim 8, wherein the electrically insulated base is formed from a plurality of blocks, each block having one or more of the plurality of terminal connectors disposed thereon.

10. The terminal block assembly of claim 8, wherein the one or more tenons and the one or more grooves form one or more sliding dovetail joints.

11. The terminal block assembly of claim 8, further comprising one or more fastening members configured to attach to the electrically insulated base when the one or more tenons have been received by the one or more grooves, and to prevent the removal of the one or more tenons from the corresponding one or more grooves while the one or more fastening members are attached to the electrically insulated base.

12. The terminal block assembly of claim 11, further comprising one or more indentations formed in the electrically insulated base near each of the one or more open ends of the one or more grooves, each of the fastening members having one or more projections for inserting into the one or more indentations.

* * * * *